US010825632B2

(12) United States Patent
Tetik

(10) Patent No.: US 10,825,632 B2
(45) Date of Patent: Nov. 3, 2020

(54) CIRCUIT BREAKER

(71) Applicant: EATON INTELLIGENT POWER LIMITED, Dublin (IE)

(72) Inventor: Adolf Tetik, Vienna (AT)

(73) Assignee: EATON INTELLIGENT POWER LIMITED, Dublin (IE)

( * ) Notice: Subject to any disclaimer, the term of this patent is extended or adjusted under 35 U.S.C. 154(b) by 297 days.

(21) Appl. No.: 15/762,578

(22) PCT Filed: Sep. 27, 2016

(86) PCT No.: PCT/EP2016/073021
§ 371 (c)(1),
(2) Date: Jun. 22, 2018

(87) PCT Pub. No.: WO2017/055303
PCT Pub. Date: Apr. 6, 2017

(65) Prior Publication Data

US 2019/0122846 A1 Apr. 25, 2019

(30) Foreign Application Priority Data

Sep. 29, 2015 (DE) ..... 10 2015 116 493

(51) Int. Cl.
*H01H 71/50* (2006.01)
*H01H 71/52* (2006.01)
(Continued)

(52) U.S. Cl.
CPC ..... *H01H 71/505* (2013.01); *H01H 3/46* (2013.01); *H01H 71/521* (2013.01); *H01H 71/526* (2013.01); *H01H 2071/0292* (2013.01)

(58) Field of Classification Search
CPC ..... H01H 2071/0292; H01H 3/46; H01H 71/505; H01H 71/521; H01H 71/526
See application file for complete search history.

(56) References Cited

U.S. PATENT DOCUMENTS 6,262,645 B1 * 7/2001 McNeil ..... H01H 71/505 335/167
6,614,334 B1 9/2003 Gibson et al.
(Continued)

FOREIGN PATENT DOCUMENTS

CN 1526150 A 9/2004
CN 1529895 A 9/2004
(Continued)

OTHER PUBLICATIONS

Machine translation of Siemens [DE 10124353] (Year: 2002).*
German Search Report of DE 10 2015 116 493.0, dated Aug. 5, 2016, German Patent Office, pp. 1 through 22.

*Primary Examiner* — Bernard Rojas
(74) *Attorney, Agent, or Firm* — Leydig, Voit & Mayer, Ltd.

(57) ABSTRACT

A switchgear, in particular a circuit protection device, includes: a housing; a fixed contact that is fixed to the housing; a movable contact, the movable contact being arranged on a contact arm that is arranged in the switchgear so as to be movable; a latching device that is connected to the contact arm; a manual actuation device that has an actuation projection, which manual actuation device is connected to the latching device by a bar, the movable contact being brought into contact with the fixed contact when the actuation projection is moved from an off-position of the actuation projection to an on-position of the actuation projection. When the actuation projection is moved from the on-position towards the off-position as far as a specified trip position of the actuation projection, the bar remains still. When the projection is moved past the trip position, the bar is moved past a holding point.

8 Claims, 4 Drawing Sheets

(51) Int. Cl.
*H01H 3/46* (2006.01)
*H01H 71/02* (2006.01)

(56) References Cited

U.S. PATENT DOCUMENTS

| | | | | |
|---|---|---|---|---|
| 6,759,931 | B1 * | 7/2004 | Lias | H01H 71/505<br>335/167 |
| 6,812,423 | B1 * | 11/2004 | Rodgers | H01H 71/2472<br>200/244 |
| 6,867,672 | B2 | 3/2005 | Vierling | |
| 7,009,129 | B2 | 3/2006 | Vierling | |
| 2017/0229260 | A1 * | 8/2017 | Zimmel | H01H 71/521 |

FOREIGN PATENT DOCUMENTS

| | | | |
|---|---|---|---|
| CN | 204011314 | U | 12/2014 |
| DE | 51066 | A | 10/1966 |
| DE | 3634456 | C1 | 2/1988 |
| DE | 10124353 | A1 | 12/2002 |
| DE | 202012001641 | U1 | 3/2012 |
| EP | 0327502 | A1 | 8/1989 |
| EP | 2061059 | A1 | 5/2009 |
| IE | 921561 | A1 | 11/1992 |
| WO | 9221134 | A1 | 11/1992 |

* cited by examiner

CIRCUIT BREAKER

CROSS-REFERENCE TO PRIOR APPLICATIONS

This application is a U.S. National Phase application under 35 U.S.C. § 371 of International Application No. PCT/EP2016/073021, filed on Sep. 27, 2016, and claims benefit to German Patent Application No. DE 10 2015 116 493.0, filed on Sep. 29, 2015. The International Application was published in German on Apr. 6, 2017 as WO 2017/055303 under PCT Article 21(2).

FIELD

The invention relates to a switchgear.

BACKGROUND

In low-voltage switchgears which comprise a manual switching knob, i.e. a manually operable element for closing the switching contacts and forming a conductive current path through the switchgear, a movable switching contact that is mechanically coupled to the manual switching knob is usually moved closer, in a continuous manner, to a switching contact that is fixed to the housing, by moving the manual switching knob until the two switching contacts mechanically abut one another. Opening the contacts, in other words disconnecting the switchgear, is correspondingly accomplished by moving the manual switching knob in question in the corresponding direction, which results in the contacts moving apart, also in a continuous manner. It is even possible here for a user, by holding the manual switching knob in any intermediate position, to also keep the contacts in a corresponding intermediate position.

If an electric potential is applied to the switchgear in question, an electric arc is formed when the two switch contacts reach a particular distance from one another. This generally does not cause a problem if the voltage is sufficiently low, and if the only electric loads in circuit are of the kind which cause only a small current flow through the switchgear.

However, in the case of higher voltages or higher currents, for example of 600V and 100 A, an electric arc of this kind, which occurs when the contacts are manually separated too slowly, can cause significant damage to the switchgear in question. If a correspondingly high current flows through the switchgear in question during the disconnection process, the electric arc, formed when the contacts are opened manually and slowly, can not only result in the total loss of the switchgear in question, but can also start a fire. This presents a serious risk, above all in the case of a direct current.

Switchgears which have a "snap-opening function" are known. In this case, the switch contacts are separated abruptly during manual switch-off, independently of the manner in which or the speed at which a user actuates a manual switching knob. However, snap-opening functions of this kind are primarily used for very large circuit breakers, such as those used in electrical substations. Switchgears of this kind comprise spring accumulators, which are to be loaded separately and which are used for closing or opening the contacts, it being almost impossible to use the relevant technology in the field of compact switchgears because the relevant technology cannot be integrated into the compact housings.

SUMMARY

In an embodiment, the present invention provides a switchgear comprising: a housing; a fixed contact that is fixed to the housing; a movable contact, the movable contact being arranged on a contact arm that is arranged in the switchgear so as to be movable; a latching device that is connected to the contact arm; a manual actuation device that has an actuation projection, which manual actuation device is connected to the latching device by a bar, the movable contact being configured to be brought into contact with the fixed contact when the actuation projection is moved from an off-position of the actuation projection to an on-position of the actuation projection, wherein, when the actuation projection is moved from the on-position towards the off-position as far as a specified trip position of the actuation projection, the bar is configured to remain still, and wherein, when the projection is moved past the trip position, the bar is configured to be moved past a holding point by the manual actuation device, and a contact-opening spring that is connected to the latching device is configured to separate the movable contact from the fixed contact.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following:

FIG. 2 is a front view of a section through an assembly comprising a latching device, a contact arm and a manual actuation device of the switchgear according to FIG. 1, in which the switchgear is switched on;

FIG. 7 is a front view of a section through the manual actuation device according to FIGS. 2 to 6 during switch-on.

DETAILED DESCRIPTION

Figure 1:
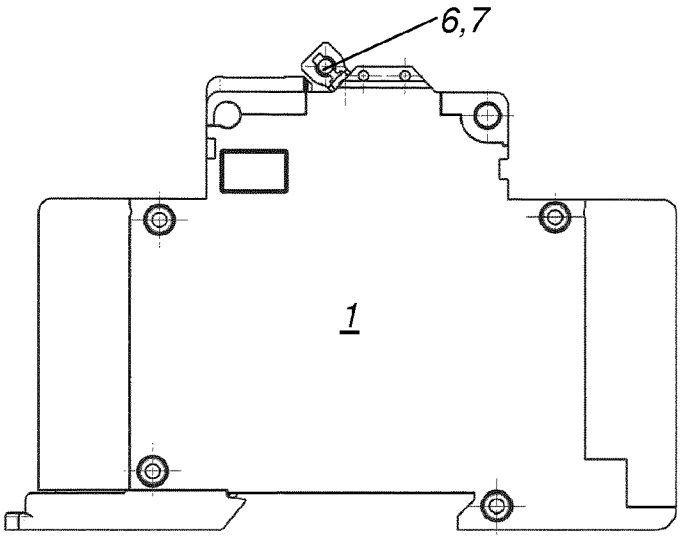
FIG. 1 is a front view of a switchgear according to the invention.

The switchgear can thus be safely manually switched off, and the contacts can therefore be safely separated, independently of the speed at which a user operates the actuation projection. In this case, the switchgear in question can be designed to have compact measurements and requires a very small number of parts. In the switchgear according to the invention, it is not necessary to release latching of the latching device in order to achieve snap-opening. The latching site of the switchgear is thus protected. Since locking does not occur when the switchgear is manually disconnected, the service life of the switchgear is increased. Since the latching is not undone when the switchgear is manually disconnected, latching release of this kind occurs only when the switchgear is tripped by a tripping device thereof, as a result of which the state of the latching site reliably indicates whether the switchgear was manually disconnected, or disconnected by a tripping device because of an electrical state. "Trip indication" can therefore be easily integrated into a switchgear according to the invention.

FIGS. 1 to 4 show a switchgear 1, or portions of a switchgear 1, that is preferably designed as a circuit protection device, the switchgear 1 comprising at least one contact 2 that is fixed to the housing, and at least one contact 3 that is movable, the movable contact 3 being arranged on a contact arm 4 that is arranged in the switchgear 1 so as to be movable, the switchgear 1 comprising a latching device 5 that is connected to the contact arm 4, the switchgear 1 also comprising a manual actuation device 6 that has an actuation projection 7, which manual actuation device 6 is connected to the latching device 5 by means of a bar 8, the movable contact 3 being brought into contact with the contact 2 that is fixed to the housing when the actuation projection 7 is moved from an off-position of the actuation projection 7 to an on-position of the actuation projection 7, thus forming a conductive current path through the switchgear 1, the manual actuation device 6 being designed such that, when the actuation projection 7 is moved from the on-position towards the off-position as far as a specified trip position of the actuation projection 7, the bar 8 remains still, and such that, when the projection is moved past the trip position towards the off-position the bar 8 is moved past a holding point by the manual actuation device, and a contact-opening spring 9 of the switchgear 1 that is connected to the latching device 5 separates the movable contact 3 from the contact 2 that is fixed to the housing.

The switchgear 1 can thus be safely switched off, and the contacts can therefore be safely separated, independently of the speed at which a user operates the actuation projection 7. In this case, the switchgear 1 in question can be designed to have compact measurements and requires a very small number of parts. In the switchgear 1 according to the invention, it is not necessary to release latching of the latching device 5 in order to achieve snap-opening. The latching site of the switchgear 1 is thus protected. Since locking does not occur when the switchgear 1 is manually disconnected, the service life of the switchgear 1 is increased. Since the latching is not undone when the switchgear 1 is manually disconnected, latching release of this kind occurs only when the switchgear 1 is tripped by a tripping device thereof, as a result of which the state of the latching site reliably indicates whether the switchgear 1 was manually disconnected, or disconnected by a tripping device because of an electrical state. "Trip indication" can therefore be easily integrated into a switchgear according to the invention.

The present invention relates to an electrical switchgear 1, the switchgear 1 preferably being designed as a circuit protection device or as a "miniature circuit breaker". The switchgear 1 is preferably designed as an automatic circuit breaker or power switch, for example. The switchgear 1 is preferably designed as a compact low-voltage switchgear. In this case, the switchgear 1 comprises at least one tripping device, according to the preferred embodiment. The switchgear 1 preferably comprises, in a conventional manner known per se, two tripping devices, specifically a short-circuit tripping device and an overvoltage tripping device. FIG. 1 is a front view of the closed switchgear 1 ready for use.

The switchgear 1 comprises at least one movable contact 3 and at least one contact 2 that is fixed to the housing. According to the preferred embodiment shown, the switchgear 1 comprises a "double break", and thus comprises two movable contacts 3 and two contacts 2 that are fixed to the housing, all of which are, however, associated with one single contact-break distance.

When the at least one movable contact 3 is in electrically conductive contact with the at least one contact 2 that is fixed to the housing, there is an electrically conductive current path through the switchgear 1. The switchgear 1 comprises connecting terminals. If there is no electrically conductive connection of this kind through the switchgear 1, it is described as being disconnected, or in a disconnected state. If the corresponding electrically conductive connection is present, it is described as being connected, or in a connected state. The transitions between the two states are correspondingly and conventionally described as connecting or disconnecting the switchgear 1. The expression "closed contacts 2, 3" can also be used synonymously with "connected", and "open contacts" can be used synonymously with "disconnected".

Figure 8:
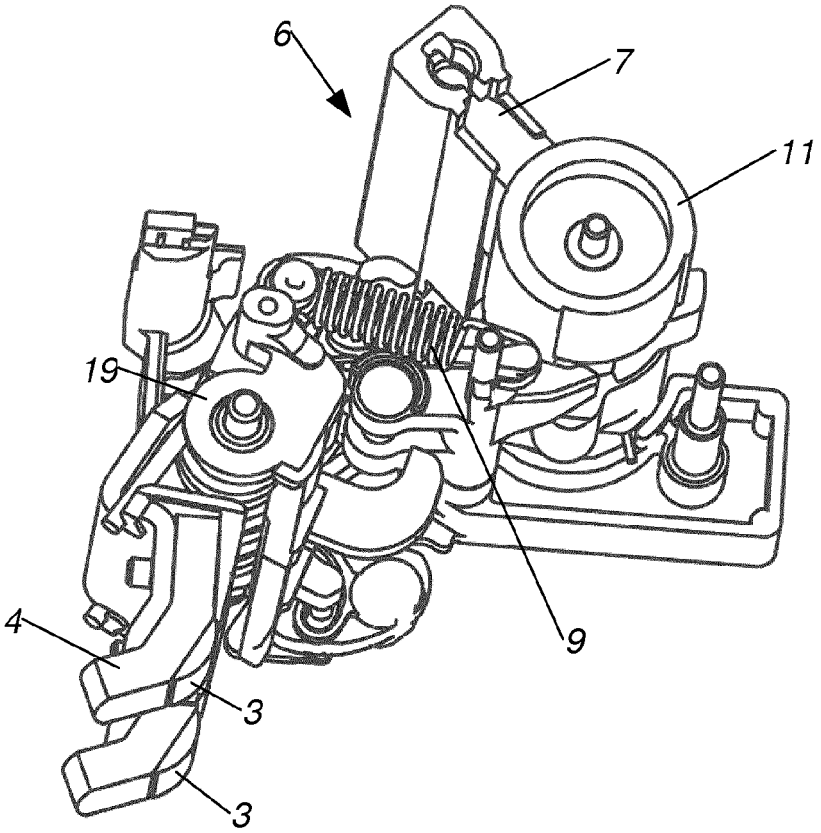
FIG. 8 is an axonometric view of a portion of the switchgear according to FIG. 1.

The at least one movable contact 3 is arranged on a movable contact arm 4. According to the preferred embodiment, the contact arm 4 (shown in FIG. 8) comprises two movable contacts 3, which are each arranged on parallel, fork-shaped projections of the contact arm 4, which can also be referred to as a contact bridge or a switching bridge in this embodiment.

The switchgear 1 comprises a latching device 5. The latching device 5 is a mechanical assembly that controls the movements of the contact arm 4. In the preferred embodiment, the latching device 5 further comprises a contact arm support 20, adjacent to the contact arm 4, a detent 18, and a detent rest 19. FIGS. 2, 3, 4 and 8 show, inter alia, the relevant assemblies detached from the other components of the switchgear 1. The latching device 5 preferably comprises even more components, which are not described.

The contact arm support 20, the contact arm 4 and the detent rest 19 are mounted in the latching device 5 so as to be movable about a common latching device rotational axis, and each comprise corresponding openings or mounting sites. The three parts 4, 19, 20 are each arranged so as to be movable relative to one another. According to the embodiment shown, two leg springs are arranged between the contact arm support 20 and the contact arm 4, which springs cause contact pressure when the contacts 2, 3 are closed, and press the contact arm 4 against the contact arm support 20 when the contacts 2, 3 are open. When the contacts 2, 3 are closed, the contact arm 4 is raised from the contact arm support 20 in regions. The detent 18 can also be referred to as a catch lever.

The detent 18 is mounted on the contact arm support 20 so as to be movable about a detent rotational axis. The detent 18 is connected to the manual actuation device 6 of the switchgear 1 by means of a bar 8 or a rod. The bar 8 can also be referred to as, or designed as, a connecting rod.

Figure 2:
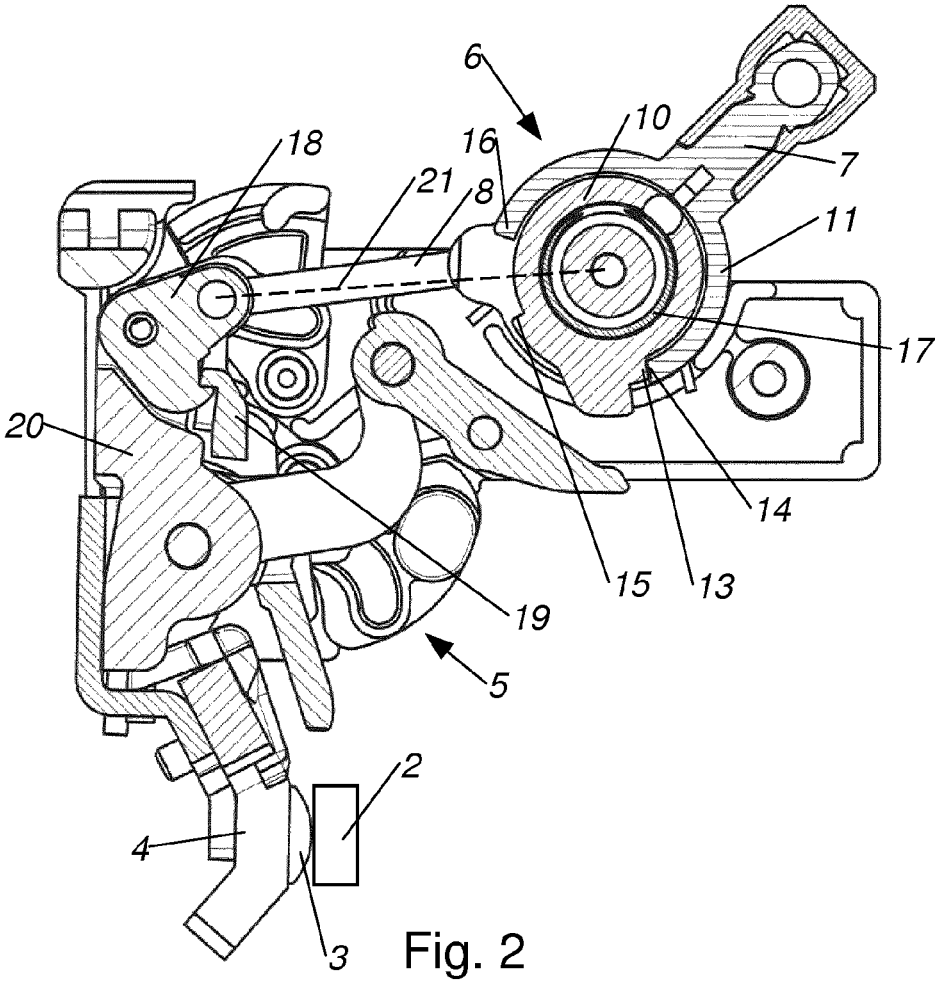
Figure 4:
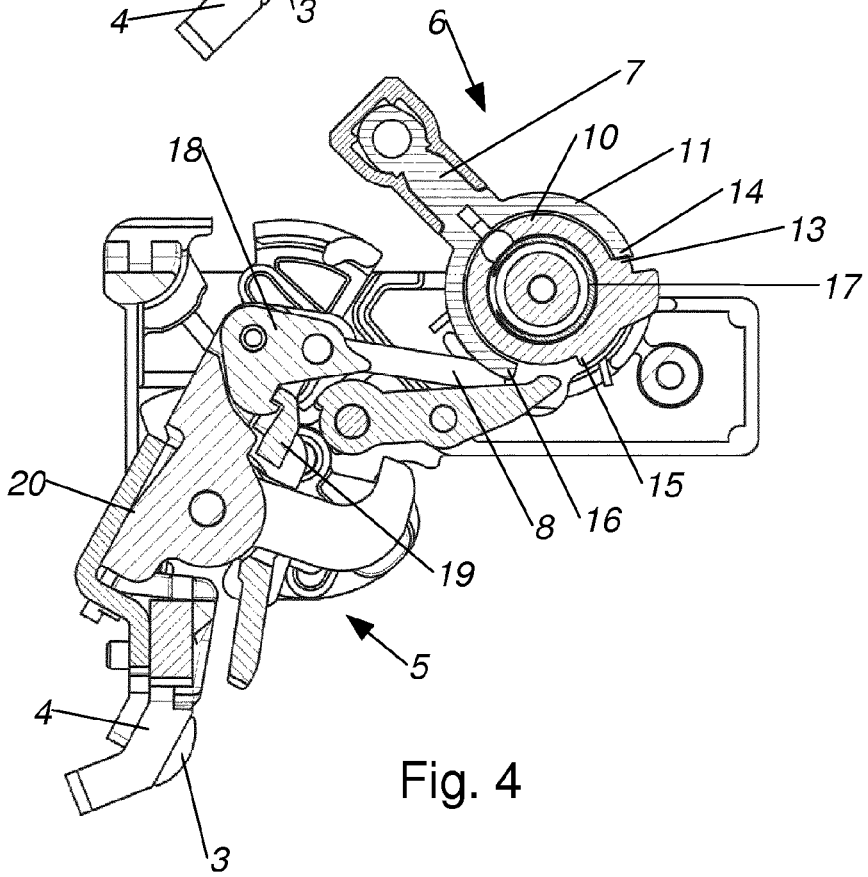
FIG. 4 is a front view of a section through the assembly according to FIG. 2, in which the switchgear is disconnected.

The detent rest 19 comprises a latching site for connection to the detent 18. In the "latched state", i.e. when the detent 18 engages in the detent rest 19, a movement of the manual actuation device 6, or of the actuation projection 7 of the manual actuation device 6, beginning from a disconnected state of the switchgear 1, is conveyed to the detent 18 by means of the bar 8. Since, owing to the latching, the detent 18 cannot move away or swing out, the contact arm support 20 and the contact arm 4 are also moved as a result of the movement of the manual actuation device 6, resulting in the switchgear 1 being connected. FIG. 4 shows the disconnected state, while FIG. 2 shows the connected state.

If the switchgear 1 is tripped by a tripping device, a portion of the tripping device moves the detent support 19, resulting in the latching between the detent 18 and the detent rest 19 being released, which causes the contacts 2, 3 to open. In this case, the at least one movable contact 3 is brought into the open position thereof, in which it is separated from the at least one contact 2 that is fixed to the housing, by means of the contact-opening spring 9. The contact-opening spring 9 is shown in the view according to FIG. 8.

The switchgear 1 comprises a mechanism for manually snap-opening the contacts. Said mechanism can also be referred to as a snap-out mechanism. In the switchgear according to the invention, the snap-out function is achieved entirely by the manual actuation device 6. The entire mechanism which causes the snap-opening of the contacts during manual switch-off is preferably arranged within the manual actuation device 6. The bar and the contact-opening spring 9 are used for other purposes within the switchgear 1.

Figure 3:
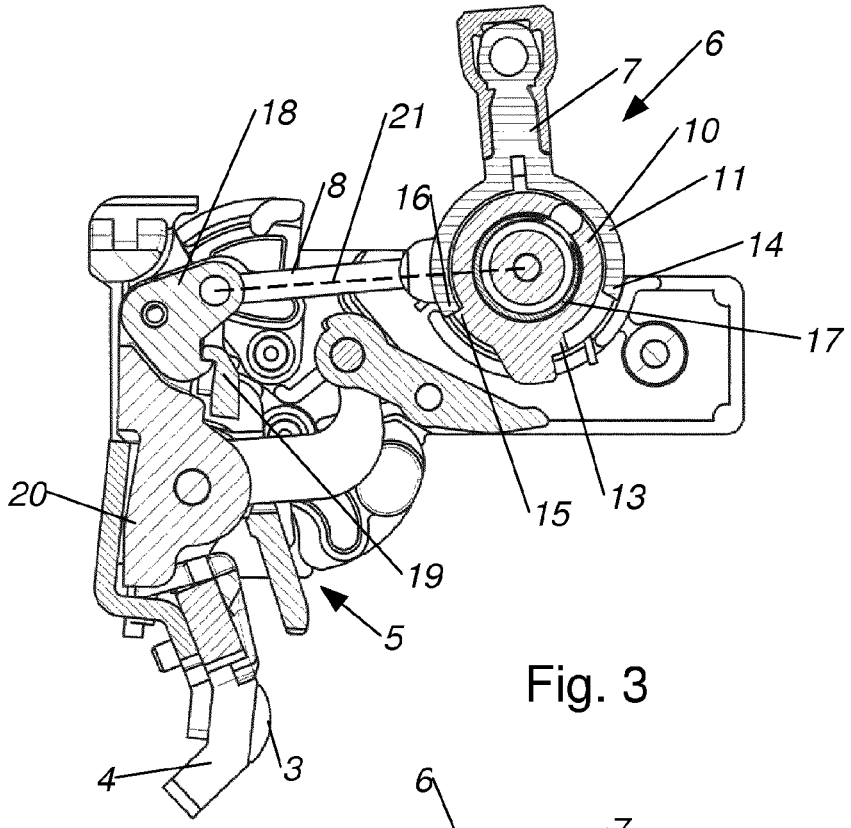
FIG. 3 is a front view of a section through the assembly according to FIG. 2, in which the manual actuation device is shown in the trip position.

The manual actuation device 6 is designed such that the bar 8 remains still when the actuation projection 7 is moved from the on-position (see FIG. 2) towards the off-position (shown in FIG. 4) as far as a specifiable trip position of the actuation projection 7. FIG. 3 shows a corresponding intermediate state in which the actuation projection 7 is located between the on-position and the off-position, just before the point at which the trip position is reached.

In FIGS. 2 and 3, the position of the bar 8 with respect to the mounting point thereof on the detent 18, and the center of rotation of the manual actuation device 6, can be seen. In FIGS. 2 and 3, there is a dashed connecting line 21 between the two aforementioned points. It can be clearly seen in FIG. 2 that the bar 8 is arranged above said connecting line 21. In this case, the bar is past the dead center. The actuation projection 7 abuts a shoulder of the switchgear housing, and is pressed against said shoulder by means of the bar 8.

In comparison with FIG. 2, a movement of the bar 8 relative to said connecting line 21 can already be seen in FIG. 3. The bar 8 is brought closer to an unstable state, in which the bar 8 is located in the same plane as the connecting line 21. The state directly before said unstable state is reached is referred to as the holding point of the bar 8.

If the actuation projection 7 is moved past the trip position when the actuation projection 7 is moved further towards the off-position, the bar 8 is moved past a holding point by means of the manual actuation device. The at least one movable contact 3 is then separated, by means of the contact-opening spring 9, from the contact 2 that is fixed to the housing.

Figure 5:
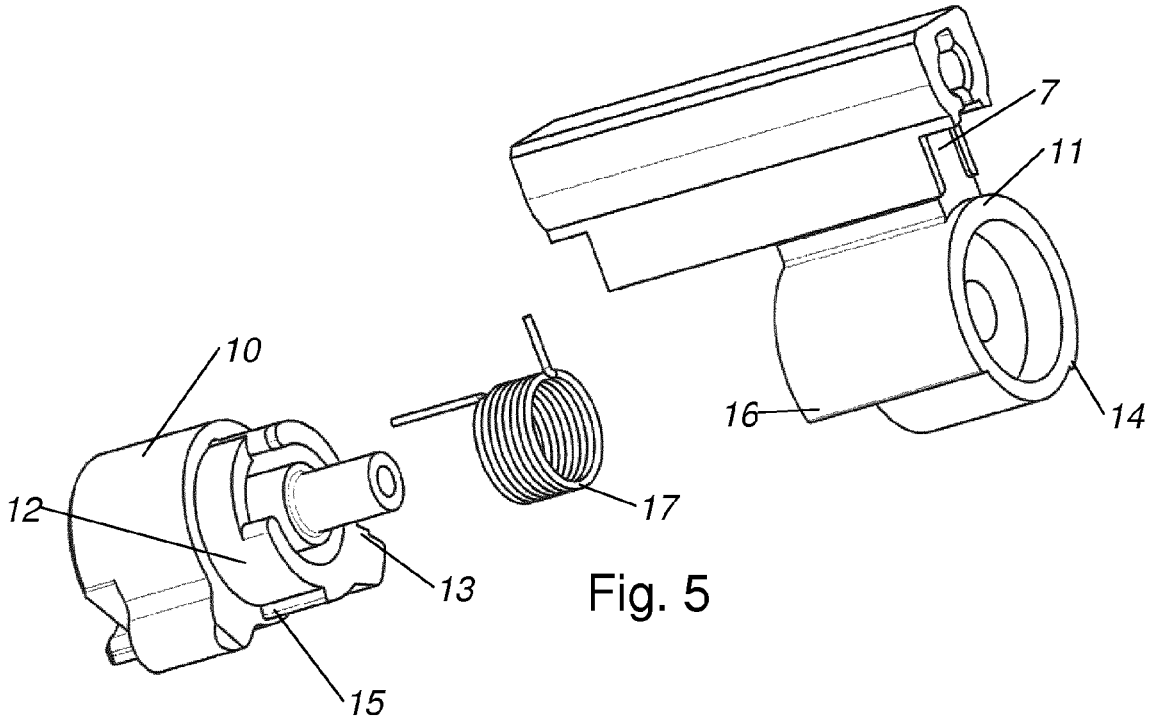
FIG. 5 is an axonometric view of the manual actuation device according to FIGS. 2 to 4.
Figure 6:
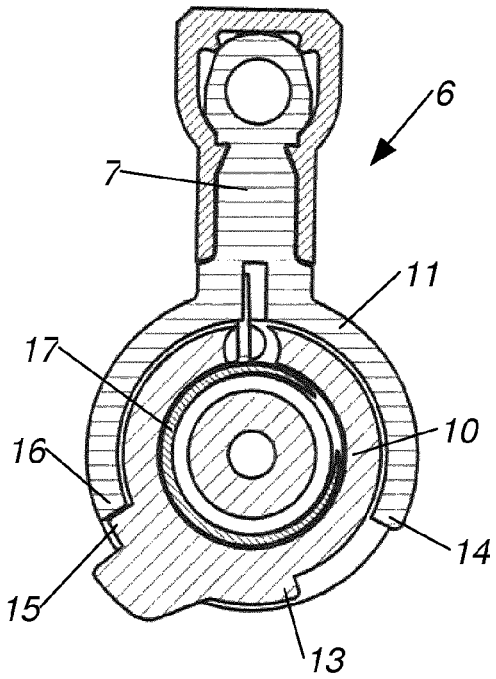
FIG. 6 is a front view of a section through the manual actuation device according to FIGS. 2 to 5 in the trip position.

As shown in FIGS. 2 to 7, the manual actuation device 6 is formed in multiple parts. The manual actuation device 6 preferably comprises a first manual actuation device part 10 and a second manual actuation device part 11. The manual actuation device 6 preferably also comprises a spring 17. FIG. 5 is an exploded view of the three parts in question.

According to the preferred embodiment, the bar 8 is mounted on the first manual actuation device part 10, and the actuation projection 7 is secured to the second manual actuation device part 11. The actuation projection 7 can therefore be moved or actuated without necessarily or always resulting in the bar 8 also being moved.

The first manual actuation device part 10 and the second manual actuation device part 11 are preferably mounted in the switchgear 1 so as to be rotatable about the same rotational axis. The first manual actuation device part 10 preferably comprises a mounting surface 12 that is cylindrical at least in regions, and the second manual actuation device part 11 is preferably mounted on the mounting surface 12 so as to be rotatable at least in regions.

The second manual actuation device 11 is therefore rotatable relative to the first manual actuation device part 10, in regions, and is mounted thereto. The rotatability of the second manual actuation device part 11 relative to the first manual actuation device part 10 is preferably limited. Said relative rotatability can be seen in FIGS. 2 to 4 and in FIGS. 6 and 7.

Figure 7:
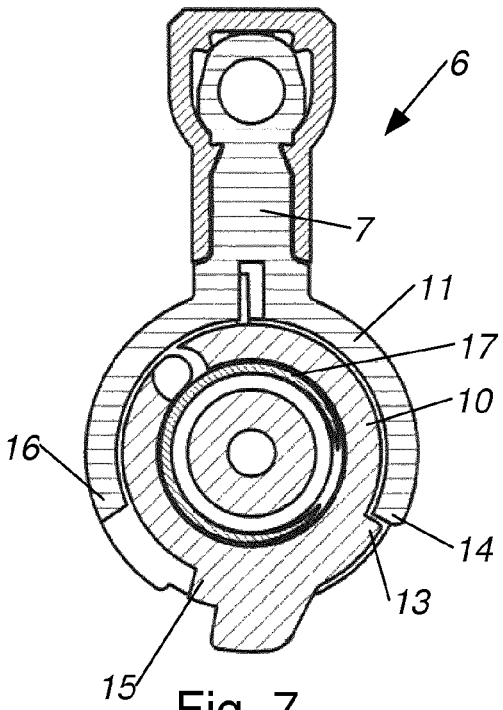

The first manual actuation device part 10 preferably comprises a first stop 13, the second manual actuation device part 11 preferably comprises a first catch edge 14, and the first catch edge 14 preferably abuts the first stop 13 in order to bring the movable contact 3 into contact with the contact 2 that is fixed to the housing. When the switchgear 1 is connected, or in order to connect the switchgear, moving the actuation projection 7 results in a movement of the bar 8. This also results in a corresponding movement of the movable contact 3 if the switchgear 1 in question does not have a snap-connecting mechanism. In any case, a movement of the actuation projection 7 in the connection direction is conveyed to the bar 8. Said coupling is ensured by the first catch edge 14 abutting the first stop 13. The corresponding state is shown in FIGS. 2 and 7.

When the switchgear 1 is disconnected, it is precisely this which is undesirable when connecting the desired coupling. According to the preferred embodiment, the first manual actuation device part 10 comprises a second stop 15, the second manual actuation device part 11 comprises a second catch edge 16, and the second catch edge 16 abuts the second stop 15 in order to move the bar 8 past the holding point. Owing to the possible relative movement between the first and the second manual actuation device parts 10, 11, the actuation projection 7 is rotated by a particular angle until the second catch edge 16 is in contact with the second stop 15, before causing the bar 8 to move.

In a switchgear 1 according to the invention, during a manual switch-off process, the two contacts 2, 3 abut one another, or are in contact with one another, with full contact pressure, until said contacts are snapped open in a manner which can no longer be influenced or controlled by the user. A corresponding movement of the actuation projection 7 from the on-position towards the off-position therefore initially does not cause either the bar or the movable contact 3 to move until the projection has moved past the trip position of the bar 8, the contact pressure being maintained as a result. If the user moves the manual actuation device 6 back to the on-position before the contacts are separated, the switchgear 1 remains connected, the corresponding actuation of the manual actuation device 6 influencing neither the position nor the contact pressure of the movable contact 3. If the user holds the manual actuation device 6 in place after the projection has moved past the trip position of the bar 8, the contacts have already been separated and holding the manual actuation device 6 in place no longer has any influence on said contact-separating process. An increase in resistance at the contact site, accompanied by an increase in temperature and wear thereof, and the occurrence of electric microarcs on the contacts 2, 3, can thus be avoided during manual switch-off. In particular in direct-current switchgears, opening the contacts 2, 3 slowly, or holding the contacts 2, 3 in an intermediate position, can lead to the total loss of the switchgear 1 within a short period of time, namely generally still during contact separation.

The trip position of the actuation projection 7 can be specified by the degree of relative mobility or relative rotatability between the first and the second manual actuation device parts 10, 11. The rotational angle range to be spanned by the actuation projection 7, before the contacts 2, 3 are irreversibly separated by the user by the impact of the contact-opening spring 9, can be specified by the degree to which the bar 8 goes past the dead center.

The spring 17, which is designed as a helical spring and is arranged between the first manual actuation device part 10 and the second manual actuation device part 11, pushes the first catch edge 14 against the first stop 13, thus making it possible for a defined position of the actuation projection 7 to be achieved.

As already demonstrated, the latching device 5 comprises a detent 18 and a detent rest 19, the detent 18 being latched to the detent rest 19. When a mechanism is designed as described according to the invention for snap-opening the contacts 2, 3 when the switchgear 1 is manually disconnected, said latching remains in place. The latching is only released when the switchgear 1 is tripped. It is thus particularly easy to implement an indication which indicates whether the switchgear 1 was tripped by a tripping device, and therefore usually because of a detected fault, or whether the switchgear 1 was disconnected manually.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A switchgear comprising:

a housing;

a fixed contact that is fixed to the housing;

a movable contact, the movable contact being arranged on a contact arm that is arranged in the switchgear so as to be movable;

a latching device that is connected to the contact arm;

a manual actuation device that has an actuation projection, which manual actuation device is connected to the latching device by a bar, the movable contact being configured to be brought into contact with the fixed contact when the actuation projection is moved from an off-position of the actuation projection to an on-position of the actuation projection, wherein, when the actuation projection is moved from the on-position towards the off-position toward a trip position of the actuation projection, the bar is configured to remain still, wherein, when the actuation projection is moved past the trip position, the bar is configured to be moved past a holding point by the manual actuation device, and a contact-opening spring that is connected to the latching device is configured to separate the movable contact from the fixed contact, wherein the manual actuation device comprises a first manual actuation device part and a second manual actuation device part, wherein the first manual actuation device part and the second manual actuation device part are mounted in the switchgear so as to be rotatable about a same rotational axis, wherein the first manual actuation device part comprises a first stop, wherein the second manual actuation device part comprises a first catch edge, wherein the first catch edge abuts the first stop in order to bring the movable contact into contact with the fixed contact, wherein the first manual actuation device part comprises a second stop, wherein the second manual actuation device part comprises a second catch edge, and wherein the second catch edge abuts the second stop in order to move the bar past the holding point.

2. The switchgear according to claim 1, wherein the bar is mounted on the first manual actuation device part, and wherein the actuation projection is secured to the second manual actuation device part.

3. The switchgear according to claim 1, wherein the first manual actuation device part comprises a mounting surface that is cylindrical at least in regions, and wherein the second manual actuation device part is mounted on the mounting surface so as to be rotatable at least in regions.

4. The switchgear according to claim 1, wherein rotatability of the second manual actuation device part relative to the first manual actuation device part is limited.

5. The switchgear according to claim 1, wherein the manual actuation device comprises a spring configured to push the first catch edge against the first stop.

6. The switchgear according to claim 5, wherein the spring comprises a helical spring which is arranged between the first manual actuation device part and the second manual actuation device part.

7. The switchgear according to claim 1, wherein the latching device comprises a detent and a detent rest, the switchgear further comprising at least one tripping device configured to trip, thus causing the fixed contact and the movable contact to separate, and wherein the detent is latched to the detent rest unless the switchgear is tripped.

8. The switchgear according to claim 1, wherein the switchgear is a circuit protection device.

* * * * *